US005909017A

United States Patent [19]

Born et al.

[11] Patent Number: 5,909,017

[45] Date of Patent: Jun. 1, 1999

[54] ELEVATOR ENERGY CONSERVATION SYSTEM

[75] Inventors: Ray W. Born, Santa Ana; Loren Ferris, Long Beach, both of Calif.

[73] Assignee: Syncro Air Lift Corp., Santa Ana, Calif.

[21] Appl. No.: 08/859,497

[22] Filed: May 20, 1997

[51] Int. Cl.[6] ..... B66B 1/28

[52] U.S. Cl. ..... 187/297; 187/290; 318/137

[58] Field of Search ..... 187/290, 297, 187/277; 318/156, 150, 137

[56] References Cited

U.S. PATENT DOCUMENTS

| | | | |
|---|---|---|---|
| Re. 32,404 | 4/1987 | Ferris | 187/100 |
| 865,819 | 9/1907 | Powell | 318/137 |
| 2,046,722 | 7/1936 | Bouton et al. | 318/140 |
| 3,658,156 | 4/1972 | Abbott | 187/297 |
| 4,489,812 | 12/1984 | Ferris | 187/100 |

*Primary Examiner*—Robert E. Nappi
*Attorney, Agent, or Firm*—Price Gess & Ubell

[57] ABSTRACT

An elevator energy conservation system is disclosed comprising an elevator motor driven by generator having two power supplies. A primary power supply provides electricity to the generator when the elevator motor is in use, while a smaller power supply using significantly less electricity powers the generator while it is idling. The two power supply system has been shown to cut the electricity usage for standard elevators by fifty percent or more over extended periods of use. Moreover, the present invention in a preferred embodiment discloses a shaft which extends from the generator which can be used to power other local machines such as air conditioners, blowers, heaters, and DC motors.

5 Claims, 1 Drawing Sheet

20
21
22
24
24a
24b
26
28
30
32
34
35
36
38
40
42
44
46
48

ELEVATOR ENERGY CONSERVATION SYSTEM

BACKGROUND OF THE INVENTION

1. Field of the Invention

The present invention relates to energy systems for powering elevators, in particularly an energy system utilizing a primary and an auxiliary motor for reducing the required power of the system.

2. Description of Related Art

Elevators are a standard fixture of practically every multistory edifice on the globe. Elevators not only provide access to disabled of otherwise inaccessible areas but provide a modem convenience to those who work and live in buildings having more than one floor. Since the inception of the elevator, a simple method has been used to power the system which is reliable and safe, and provides the greatest convenience to the user. Most elevators operate by means of a tried and true system whereby a large DC (direct current) motor is used to lift a cabin suspended by cables. The DC elevator motor is necessarily large in order to generate the great power required to lift the cabin from a stand still with its maximum load capacity, further accounting for overloads and factors of safety. While such a motor could be operated directly from the AC (alternating current) source supplied directly from the power company, for several reasons it is more efficient to have a localized direct current supply available from which to draw the current needed for the elevator motor. First, there is a large surge in the current when such a motor is started resulting a spike, which is dangerous to the system and its components. The spike also results in a peak current, which in most areas determines the supplier's rate at which a designated period of usage costs the user. That is, if the pre-set interval that the power company charges a customer is four hours, the large spike at the ignition of the DC motor during the four hour period sets the rate for the entire period (even if the spike lasts only a few seconds). For this reason, most systems employ a DC generator which provides a ready source of DC current for the DC motor which operates the elevator.

The presence of the DC generator solves the problem of a spike occurring when the elevator motor is started, but the generator itself requires a source of power. Typical systems employ a large AC motor to run the DC generator, and usually this combination is sold as a single motor/generator unit. With the AC motor running continuously, the generator provides a constant source of power to the elevator motor eliminating all but the most minor spikes in the current draw. However, the problem lies in the continuous running of large AC motor. A large AC motor running under a no load condition, i.e., with the elevator motor not drawing power from the generator, will still require a current of up to 40% of the maximum load current. When this current is projected over a twenty four hour period, as many elevators require, and then over a 365 day year, the cost of simple powering the elevator is staggering. This is true especially when one considers that the elevator is actually being used in the neighborhood of 20 percent of the time during peak hours.

To date, the inventor knows of no solution which has been attempted to reduce the power in elevator systems while meeting the safety requirements and operational parameters of existing elevator systems. A solution should ideally be adapted for use with existing systems with little modification, and should be applicable to different sizes and capacity elevators.

SUMMARY OF THE INVENTION

It is therefore a first object of the present invention to provide a more cost effective system for powering elevators.

It is another object of the present invention to provide a system which requires less energy to operate while providing similar output to existing systems.

It is yet another object of the present invention to provide a system which can be used to recapture energy in order to power other machines in the building.

The objects and general purpose of the present invention are accomplished by a system in which a small auxiliary motor is added to the system, and this small auxiliary motor is used to maintain the speed of the generator at an operational speed under no load conditions. Switching allows the large AC motor to activate when a load is placed on the generator, but the energy required is significantly less due to the rotation of the generator at operational speed. Flexible coupling allows the generator shaft to be coupled to the small auxiliary motor, or other coupling means are available. Furthermore, in one preferred embodiment, the shaft of the small motor is extended to a bearing, and the rotation of the shaft can be used to recapture the mechanical energy. For example, pulleys disposed on the shaft and connected to pumps or compressors can be used to operate these machines at significantly savings when compared with individual motors associated each of these machines. The present invention is easy to construct and requires little in the way of modification to existing elevator systems.

BRIEF DESCRIPTION OF THE DRAWINGS

The exact nature of this invention, as well as its objects and advantages, will become readily apparent upon reference to the following detailed description when considered in conjunction with the accompanying drawing, wherein.

DETAILED DESCRIPTION OF THE PREFERRED EMBODIMENTS

Figures 1, 2:
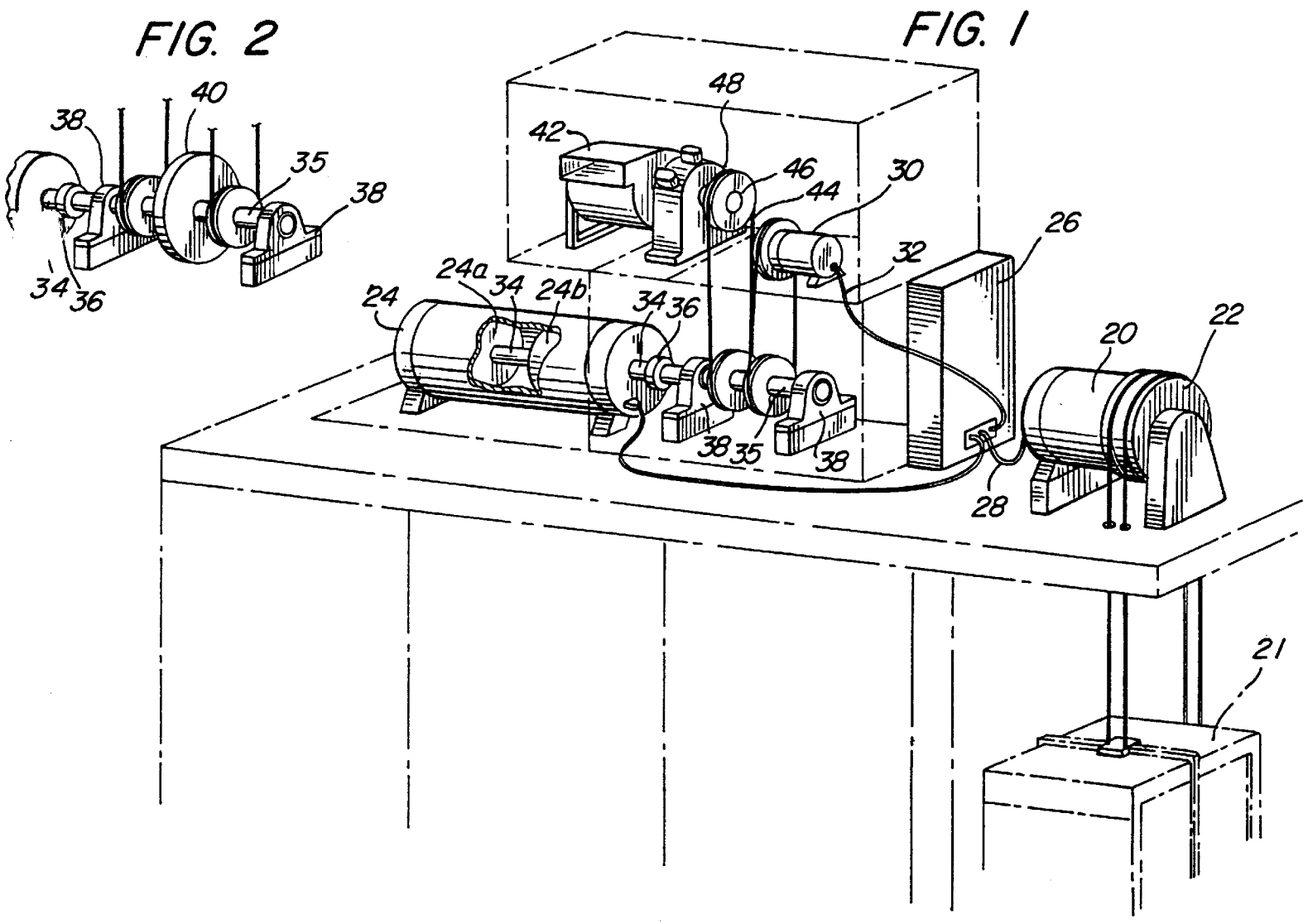
FIG. 1 is a perspective view of the system of the present invention illustrating the components and their relationships.
FIG. 2 is a perspective view of a portion of the figure shown in FIG. 1.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an elevator power system which minimizes power usage.

A preferred embodiment of present invention is illustrated generally in FIG. 1, which illustrates an elevator motor 20 which drives an elevator cable sheave 22, as is known in the elevator art, and a system for supplying power to the elevator motor 20. The power supply comprises a large AC motor 24*a* and a DC generator 24*b* combined into a single unit 24, although in practice they may be separate devices which are coupled together using the appropriate linkages. As a single unit, the AC motor 24*a* operates independently of the DC generator 24*b* such that the generator can operate while the AC motor is off. Both the DC generator 24*b* and the AC motor 24*a* are connected to a controller 26 which activates and deactivates the AC motor 24*a* as well as receives and transmits the DC current generated by the DC generator 24*b* to the elevator motor 20 via an electrically conducting connection 28. The controller 26 is also connected to an AC power supply (not shown) such as a standard wall outlet and the AC power supply is used to operate the AC motor 24*a*. The controller includes a switch which allows the controller to create and break a circuit between the AC power supply and the AC motor 24*b*.

The DC generator 24*b* includes a shaft 34 which extends from the AC motor 24*a* and is coupled to the DC generator

24*b*, and further extends a short distance out of the DC generator 24*b*. Although current off the shelf AC motor/DC generators do not currently include an extended shaft, the shaft 34 can be modified or through the use of a flexible coupling 36, extended from the DC generator 24*b* such that an additional length of shaft is external to the DC generator 24*b*. The extended shaft 35 is preferably mounted on a pair of bearings 38 as shown and rotates in conjunction with the DC generator 24*b*.

A small, AC motor 30 is placed proximally to the extended shaft 35 and connects to the extended shaft 35 using a belt 40, or other such means such that the smaller motor 30 turns the extended shaft 35. The smaller motor 30 is preferably a low torque, constant speed motor chosen for the particular application and operates at significantly less current than the primary AC motor 24*a*. The smaller motor 30 is connected to the controller 26 using an electrical cable 32 such the controller 26 can operate the smaller motor 30, although for the present application the smaller motor 30 operates continuously. The effect of operating the smaller motor 30 continuously is that rotation of the extended shaft 35 and consequently rotation of the shaft 34 are maintained at a constant speed, which should coincide with the normal operating speed of the DC generator 24*b* under no load. That is, the small motor 30 in effect keeps the DC generator 24*b* running under idle conditions while the controller 26 shuts off the AC motor 24*a*.

When the system is first started up, such as would be the case of a power up condition in the morning or after a power outage, current from the AC power supply is supplied the controller 26, which directs current to the small AC motor 30. The controller 26 prevents the primary AC motor 24*a* from starting until the small motor 30 is turning the shaft 34 at full speed, thereby preventing a surge to the primary AC motor. With the DC generator 24*b* turning at full speed, the primary AC motor 24*a* becomes available but remains off until the elevator motor 20 is needed to move the elevator cabin 21. Typically a relay system on each floor will activate the elevator motor 20 when the elevator cabin 21 is summoned, causing a signal to be sent from the motor 20 to the controller 26. The controller 26 then activates the primary AC motor 24*a* which supplies the additional power necessary to the DC generator 24*b* to accommodate the load placed by the elevator motor 20. However, with the DC generator 24*b* already running at maximum speed due to the operation of the small motor 30, the incremental load required is significantly less and the power surge in the primary AC motor 24*a* is diminished by the operation of the small AC motor 30. To further reduce the power surge, a large flywheel 40 as shown in FIG. 2 can be mounted on the shaft 35 to build up a rotational inertia, causing each intermittent demand on the DC generator 24*b* to be damped out.

The savings in electricity can be illustrated by the following example. In tests, a 100 horsepower primary AC motor and DC generator were used as might be the case with a medium sized elevator. The current required to run the primary AC motor is approximately 40 amp, and without the present invention the primary motor must run all day long so that there is no delay in the operation of the elevator. With a 5 horsepower auxiliary AC motor connected to the generator's shaft, the generator can be run at full speed using approximately 4 amps, saving the user considerable costs in electricity. Furthermore, when a large flywheel is placed on the shaft, the surge in electricity from the primary AC motor kicking in to meet the demand of the elevator motor is practically negligible. As can be seen, the savings from a single elevator can amount to significant money over extended periods of time.

A preferred alternate embodiment of the system described above is that additional energy savings are possible by utilizing the energy of the rotating shaft 35 to power other local energy consuming units 42 such as air conditioners, pumps, compressors, and the like. FIG. 1 illustrates a preferred embodiment where a device 42, here illustrated by way of example as an air blower, is run using energy recovered from the rotation of the shaft 35. A pulley system 44 connecting the shaft 35 with a shaft 46 on a AC motor 48 which runs the air blower illustrates the utilization of the rotation of the shaft 35. To increase energy savings, multiple power consuming devices can be connected to the shaft 35 to conserve more energy. Each individual AC motor is connected (not shown) to the controller 26 so that the primary motor 24*a* can be accessed when the drain on the DC generator 24*b* causes its rotation to fall below the operational speed. The controller 26 ensures that the fill power is constantly available to the elevator motor 20 in accordance with the operating parameters of the elevator.

It will be understood that the embodiment described herein are merely exemplary and that a person skilled in the art may make many variations and modifications without departing from the spirit and scope of the invention. All such variations and modifications are intended to be included within the scope of the invention as defined in the appended claims.

What is claimed is:

1. An elevator power conservation system comprising:

a primary AC motor;

a generator having a primary shaft operably connected to said primary AC motor;

a secondary shaft coupled to said primary shaft of said generator and mounted on first and second bearings to minimize any side loading on said secondary shaft from being transferred to said primary shaft;

a secondary AC motor driving said secondary shaft, whereby operation of said secondary AC motor turns said secondary shaft at a speed which results in said primary shaft and said primary AC motor running at a predetermined operable speed under no loading from an elevator car.

2. The elevator power conservation system of claim 1 further comprising a switch connected to said primary AC motor, said switch activating said primary AC motor when an elevator car moving load is applied to said generator, and deactivating said primary AC motor when said elevator car moving load is removed.

3. The elevator power conservation system of claim 1 further comprising a belt operably connecting said secondary shaft to a local power consuming unit, whereby rotation of said secondary shaft by said secondary AC motor powers said local power consuming unit.

4. The elevator power conservation system of claim 3 wherein a switch connected to said primary AC power activates said primary AC motor when said local power consuming unit causes a load to be applied to said secondary shaft.

5. The elevator power conservation system of claim 1 further comprising a flywheel operably mounted on said secondary shaft.

* * * * *